US010976080B2

(12) United States Patent
Xu et al.

(10) Patent No.: US 10,976,080 B2
(45) Date of Patent: Apr. 13, 2021

(54) PULSE TUBE CRYOCOOLER AND METHOD OF MANUFACTURING PULSE TUBE CRYOCOOLER

(71) Applicant: SUMITOMO HEAVY INDUSTRIES, LTD., Tokyo (JP)

(72) Inventors: Mingyao Xu, Nishitokyo (JP); Takashi Hirayama, Nishitokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 236 days.

(21) Appl. No.: 16/233,045

(22) Filed: Dec. 26, 2018

(65) Prior Publication Data

US 2019/0195538 A1 Jun. 27, 2019

(30) Foreign Application Priority Data

Dec. 26, 2017 (JP) ..... JP2017-248798

(51) Int. Cl.
*F25B 9/14* (2006.01)
*F25B 9/10* (2006.01)

(52) U.S. Cl.
CPC ..... *F25B 9/145* (2013.01); *F25B 9/10* (2013.01); *F25B 2309/1412* (2013.01); *F25B 2309/1418* (2013.01)

(58) Field of Classification Search
CPC .... F25B 9/00; F25B 9/145; F25B 9/10; F25B 9/14
See application file for complete search history.

(56) References Cited

U.S. PATENT DOCUMENTS 5,519,999 A * 5/1996 Harpole ..... F02G 1/0445 60/520
2007/0157632 A1 7/2007 Saito

FOREIGN PATENT DOCUMENTS

JP 2006-284061 A 10/2006

* cited by examiner

*Primary Examiner* — Frantz F Jules
*Assistant Examiner* — Erik Mendoza-Wilkenfel
(74) *Attorney, Agent, or Firm* — HEA Law PLLC

(57) ABSTRACT

A pulse tube cryocooler is furnished with a second-stage cooling stage and an insert. The second-stage cooling stage has a lateral-surface opening, and a first heat-exchange surface extending in a sideways direction from the lateral-surface opening into the second-stage cooling stage. The insert includes a base-end portion fixedly fitted into the second-stage cooling stage to plug the lateral-surface opening, and a second heat-exchange surface that extends in the sideways direction from the base-end portion and is disposed inside the second-stage cooling stage, opposing the first heat-exchange surface. Between the first heat-exchange surface and the second heat-exchange surface the insert forms a clearance that flows a working gas, bringing both the first heat-exchange surface and the second heat-exchange surface into contact with the working gas.

7 Claims, 7 Drawing Sheets

32

PULSE TUBE CRYOCOOLER AND METHOD OF MANUFACTURING PULSE TUBE CRYOCOOLER

RELATED APPLICATIONS

The content of Japanese Patent Application No. 2017-248798, on the basis of which priority benefits are claimed in an accompanying application data sheet, is in its entirety incorporated herein by reference.

BACKGROUND

Technical Field

The present invention in certain embodiments relates to a pulse tube cryocooler and a method of manufacturing a pulse tube cryocooler.

Description of Related Art

To constitute the cooling stage of a pulse tube cryocooler from a cooling-stage component and a lid component has been known to date. The lid component is fitted on in a way such that it covers the cooling-stage component. The lid component has two connection holes, and these connection holes are connected respectively to the pulse tube and the regenerator. The cooling-stage body is therefore connected to the pulse tube and the regenerator via the lid component. Multiple slits extending rectilinearly from directly below one of the connection holes in the lid component to directly below the other of the connection holes are formed in the top side of the cooling-stage component. These slits form helium-gas flow paths from the regenerator to the pulse tube, wherein the cooling-stage component functions as a heat exchanger.

SUMMARY

According to an aspect of the invention, a pulse tube cryocooler is furnished with: a longitudinally extending pulse tube; a regenerator extending in the longitudinal direction of the pulse tube and disposed in a sideways direction apart from and paralleling the pulse tube; a cooling stage coupling one longitudinal end of the pulse tube and one longitudinal end of the regenerator to allow a working gas to flow between the two longitudinal ends, and having a lateral-surface opening, and a first heat-exchange surface extending in the sideways direction into the cooling stage from the lateral-surface opening; and an insert furnished with a base-end portion fixedly fitting into the cooling stage to plug the lateral-surface opening, and with a second heat-exchange surface extending in the sideways direction from the base-end portion and disposed inside the cooling stage, opposing the first heat-exchange surface; wherein between the first heat-exchange surface and the second heat-exchange surface the insert forms a clearance for flowing the working gas so that both the first heat-exchange surface and the second heat-exchange surface come into contact with the working gas.

The invention in another aspect affords a method of manufacturing a pulse tube cryocooler. The pulse tube cryocooler includes a longitudinally extending pulse tube, and a regenerator extending in the longitudinal direction of the pulse tube and disposed in a sideways direction apart from and paralleling the pulse tube. The method comprises forming in the cooling stage a lateral-surface opening, and also forming in the cooling stage a first heat-exchange surface extending in the sideways direction into the cooling stage from the lateral-surface opening; inserting an insert, furnished with a base-end portion and a second heat-exchange surface, through the lateral-surface opening such that the second heat-exchange surface extends in the sideways direction from the base-end portion and is disposed inside the cooling stage, opposing the first heat-exchange surface; fixedly fitting the insert into the cooling stage such that the base-end portion plugs the lateral-surface opening; and coupling one longitudinal end of the pulse tube and one longitudinal end of the regenerator to allow a working gas to flow between the two longitudinal ends. Between the first heat-exchange surface and the second heat-exchange surface the insert forms a clearance that flows the working gas to bring both the first heat-exchange surface and the second heat-exchange surface into contact with the working gas.

DETAILED DESCRIPTION

Figure 1:
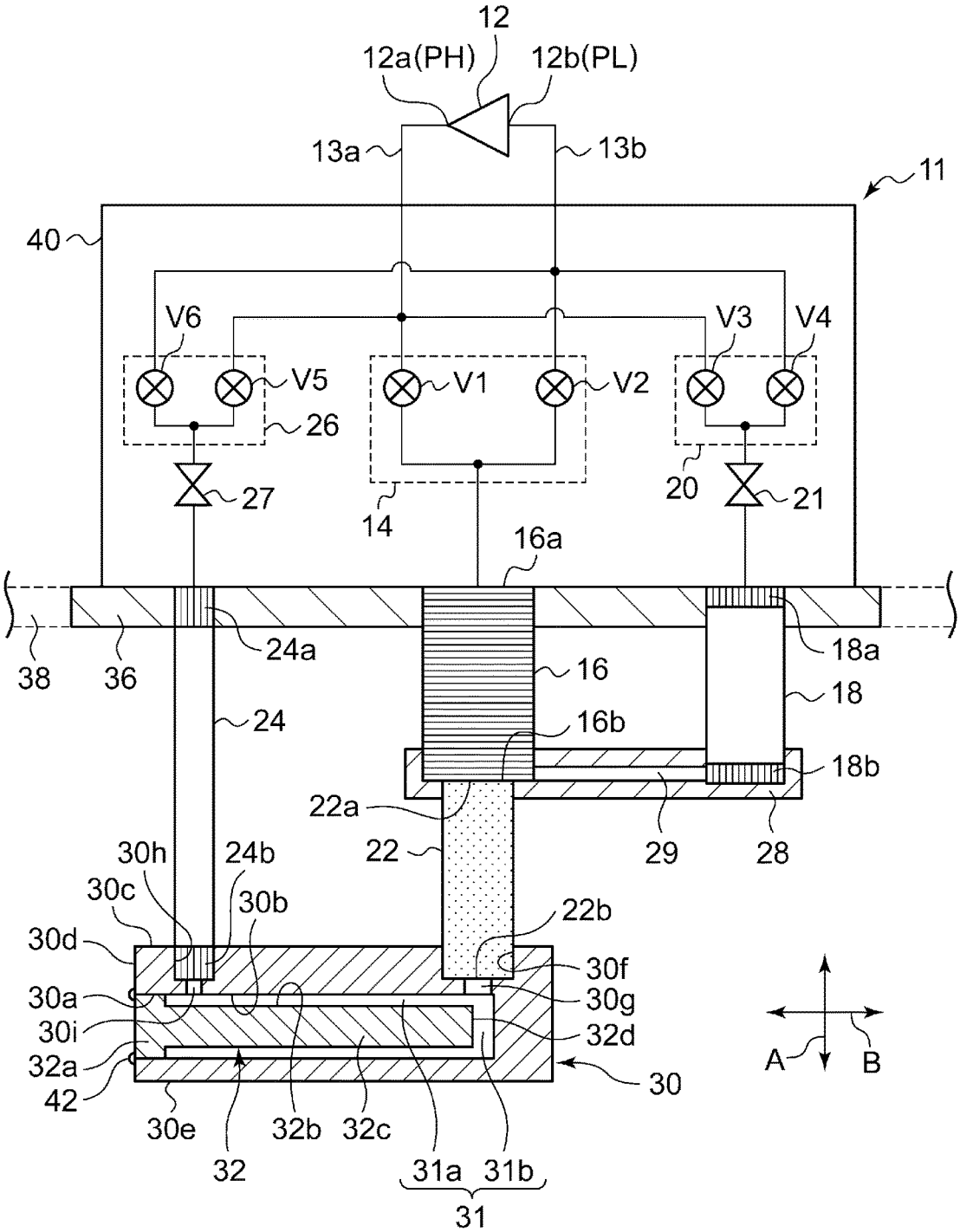
FIG. 1 is a schematic view illustrating a pulse tube cryocooler involving one embodying mode.

The area of contact between gas and the cooling stage is widened by providing the cooling stage of a pulse tube cryocooler with the slit-type gas flow passages as described above. Therefore, the heat exchange efficiency is enhanced, and the refrigeration performance of the pulse tube cryocooler is also improved. However, the slit structure is complicated in manufacture and causes a rise in manufacturing cost.

It is desirable to provide a pulse tube cryocooler having a cooling stage structure in which an increase in the area of heat exchange with a working gas can be realized at low costs.

In addition, arbitrary combinations of the above constituent elements and those obtained by substituting the constituent elements or expressions of the invention with each other among methods, devices, systems, and the like are also effective as aspects of the inventions.

According to the invention, the pulse tube cryocooler having the cooling stage structure in which an increase in the area of heat exchange with the working gas can be realized at low costs can be provided.

Hereinafter, modes for carrying out the invention will be described in detail, referring to the drawings. In addition, the same elements in the description will be designated by the same reference signs, and the duplicate description thereof will be appropriately omitted. Additionally, the configuration to be described below is merely exemplary and does not limit the range of the invention at all. Additionally, in the drawings to be referred to in the following description, the size and thickness of respective constituent members are for convenience of description, and do not necessarily indicate actual dimensions and ratios.

FIG. 1 is a schematic view illustrating a pulse tube cryocooler 10 involving the present embodiment. The pulse tube cryocooler 10 includes a cold head 11 and a compressor 12. The cold head 11 includes a first-stage cooling stage 28 and a second-stage cooling stage 30. The cold head 11 further includes an insert 32, whose details will be described later, that is inserted into the second-stage cooling stage 30 in order to form flow channels and increase the heat exchange area in the second-stage cooling stage 30.

The pulse tube cryocooler 10 is a Gifford-McMahon (GM) type four-valve pulse tube cryocooler as an example. Therefore, the pulse tube cryocooler 10 includes a main pressure switching valve 14, a first-stage regenerator 16, a first-stage pulse tube 18, and a first-stage phase control mechanism having a first-stage auxiliary pressure switching valve 20 and optionally a first-stage flow rate adjustment element 21. The compressor 12 and the main pressure switching valve 14 constitute an oscillating flow generation source of the pulse tube cryocooler 10. The compressor 12 is shared by the oscillating flow generation source and the first-stage phase control mechanism.

Additionally, the pulse tube cryocooler 10 is a two-stage cryocooler, and further includes a second-stage regenerator 22, a second-stage pulse tube 24, and a second-stage phase control mechanism having a second-stage auxiliary pressure switching valve 26 and optionally a second-stage flow rate adjustment element 27. The compressor 12 is also shared by the second-stage phase control mechanism.

In the present specification, in order to describe a positional relationship between constituent elements of the pulse tube cryocooler 10, terms "longitudinal direction A" and "sideways direction B" are used for convenience. Typically, the longitudinal direction A and the sideways direction B are respectively an axial direction and a radial direction of the pulse tube (18, 24) and the regenerator (16, 22). However, the longitudinal direction A and the sideways direction B may be directions substantially orthogonal to each other; it is not required that they be "strictly orthogonal." Additionally, the notation of the longitudinal direction A and the sideways direction B does not limit a posture in which the pulse tube cryocooler 10 is installed at a point of use. The pulse tube cryocooler 10 is capable of being installed in a desired posture, for example, may be installed such that the longitudinal direction A and the sideways direction B are respectively directed to a vertical direction and a horizontal direction, or contrarily, may be installed such that the longitudinal direction A and the sideways direction B are respectively directed to the horizontal direction and the vertical direction. Alternatively, the pulse tube cryocooler 10 may be installed such that the longitudinal direction A and the sideways direction B are respectively directed to oblique directions different from each other.

The two regenerators (16, 22) are connected in series, and extend in the longitudinal direction A. The two pulse tubes (18, 24) extend in the longitudinal direction A, respectively. The first-stage regenerator 16 is disposed in parallel with the first-stage pulse tube 18 in the sideways direction B, and the second-stage regenerator 22 is disposed in parallel with the second-stage pulse tube 24 in the sideways direction B. The first-stage pulse tube 18 has almost the same length as the first-stage regenerator 16 in the longitudinal direction A, and the second-stage pulse tube 24 has almost the same length as the total length of the first-stage regenerator 16 and the second-stage regenerator 22 in the longitudinal direction A. The regenerator (16, 22) and the pulse tube (18, 24) are disposed substantially parallel to each other.

The compressor 12 has a compressor discharge port 12*a* and a compressor suction port 12*b*, and is configured so as to compress a recovered working gas of low pressure PL to create a working gas of high pressure PH. The working gas is supplied from the compressor discharge port 12*a* through the first-stage regenerator 16 to the first-stage pulse tube 18, and the working gas is recovered from the first-stage pulse tube 18 through the first-stage regenerator 16 to the compressor suction port 12*b*. Additionally, the working gas is supplied from the compressor discharge port 12*a* through the first-stage regenerator 16 to the second-stage pulse tube 24, and the second-stage regenerator 22, and the working gas is recovered from the second-stage pulse tube 24 through the second-stage regenerator 22 and the first-stage regenerator 16 to the compressor suction port 12*b*. The compressor discharge port 12*a* and the compressor suction port 12*b* respectively function as a high-pressure source and a low-pressure source of the pulse tube cryocooler 10. The working gas is also referred to as refrigerant gas, and is, for example, helium gas.

The main pressure switching valve 14 has a main suction opening/closing valve V1 and a main exhaust opening/closing valve V2. The first-stage auxiliary pressure switching valve 20 has a first-stage auxiliary suction opening/closing valve V3 and a first-stage auxiliary exhaust opening/closing valve V4. The second-stage auxiliary pressure switching valve 26 has a second-stage auxiliary suction opening/closing valve V5 and a second-stage auxiliary exhaust opening/closing valve V6.

The pulse tube cryocooler 10 is provided with a high-pressure line 13*a* and a low-pressure line 13*b*. The working gas of the high pressure PH flows from the compressor 12 through the high-pressure line 13*a* into the cold head 11. The working gas of the low pressure PL flows from the cold head 11 through the low-pressure line 13*b* into the compressor 12. The high-pressure line 13*a* connects the compressor discharge port 12*a* to the suction opening/closing valves (V1, V3, and V5). The low-pressure line 13*b* connects the compressor suction port 12*b* to the exhaust opening/closing valves (V2, V4, and V6).

The first-stage regenerator 16 has a first-stage regenerator high-temperature end 16*a* and a first-stage regenerator low-temperature end 16*b*, and extends in the longitudinal direction A from the first-stage regenerator high-temperature end 16*a* to the first-stage regenerator low-temperature end 16*b*. The first-stage regenerator high-temperature end 16*a* and the first-stage regenerator low-temperature end 16*b* may be respectively referred to as a first end and a second end of the first-stage regenerator 16. Similarly, the second-stage regenerator 22 has a second-stage regenerator high-temperature end 22*a* and a second-stage regenerator low-temperature end 22*b*, and extends in the longitudinal direction A from the second-stage regenerator high-temperature end 22*a* to the second-stage regenerator low-temperature end 22*b*. The second-stage regenerator high-temperature end 22*a* and the second-stage regenerator low-temperature end 22*b* may be respectively referred to as a first end and a second end of the second-stage regenerator 22. The first-stage regenerator low-temperature end 16*b* communicates with the second-stage regenerator high-temperature end 22*a*.

The first-stage pulse tube 18 has a first-stage pulse tube high-temperature end 18*a* and a first-stage pulse tube low-temperature end 18*b*, and extends in the longitudinal direction A from the first-stage pulse tube high-temperature end 18*a* to the first-stage pulse tube low-temperature end 18*b*. The first-stage pulse tube high-temperature end 18*a* and the first-stage pulse tube low-temperature end 18*b* may be respectively referred to as a first end and a second end of the first-stage pulse tube 18.

Similarly, the second-stage pulse tube 24 has a second-stage pulse tube high-temperature end 24*a* and a second-stage pulse tube low-temperature end 24*b*, and extends in the longitudinal direction A from the second-stage pulse tube high-temperature end 24*a* to the second-stage pulse tube low-temperature end 24*b*. The second-stage pulse tube high-temperature end 24*a* and the second-stage pulse tube low-temperature end 24*b* may be respectively referred to as a first end and a second end of the second-stage pulse tube 24.

In an exemplary configuration, the regenerator (16, 22) is a cylindrical tube the interior of which is filled with a cold storage material, and the pulse tube (18, 24) is a cylindrical tube the interior of which is a cavity.

Each of both ends of the pulse tube (18, 24) may be provided with a flow straightener for equalizing the working gas velocity distribution within a plane perpendicular to the axial direction of the pulse tube or performing adjustment to a desired distribution. The flow straightener also functions as a heat exchanger.

The first-stage regenerator 16 and the first-stage pulse tube 18 extend in the same direction from the first-stage cooling stage 28, and the first-stage regenerator high-temperature end 16*a* and the first-stage pulse tube high-temperature end 18*a* are disposed on the same side with respect to the first-stage cooling stage 28. In this way, the first-stage regenerator 16, the first-stage pulse tube 18, and the first-stage cooling stage 28 are disposed in the form of a U. Similarly, the second-stage regenerator 22 and the second-stage pulse tube 24 extend in the same direction from the second-stage cooling stage 30, and the second-stage regenerator high-temperature end 22*a* and the second-stage pulse tube high-temperature end 24*a* are disposed on the same side with respect to the second-stage cooling stage 30. In this way, the second-stage regenerator 22, the second-stage pulse tube 24, and the second-stage cooling stage 30 are disposed in the form of a U.

The first-stage pulse tube low-temperature end 18*b* and the first-stage regenerator low-temperature end 16*b* are structurally connected to each other and thermally combined with each other by the first-stage cooling stage 28. A first-stage communication passage 29 is formed in the first-stage cooling stage 28. The first-stage pulse tube low-temperature end 18*b* is in fluid communication with the first-stage regenerator low-temperature end 16*b* through the first-stage communication passage 29. Hence, the working gas supplied from a compressor 12 can flow from the first-stage regenerator low-temperature end 16*b* through the first-stage communication passage 29 to the first-stage pulse tube low-temperature end 18*b*. The return gas from the first-stage pulse tube 18 can flow from the first-stage pulse tube low-temperature end 18*b* through the first-stage communication passage 29 through the first-stage regenerator low-temperature end 16*b*.

Similarly, the second-stage pulse tube low-temperature end 24*b* and the second-stage regenerator low-temperature end 22*b* are structurally connected to each other and thermally combined with each other by the second-stage cooling stage 30. A clearance 31 serving as a second-stage communication passage is formed inside the second-stage cooling stage 30. A clearance 31 is a gap between the second-stage cooling stage 30 and the insert 32. The second-stage pulse tube low-temperature end 24*b* is in fluid communication with the second-stage regenerator low-temperature end 22*b* through the clearance 31. Hence, the working gas supplied from the compressor 12 can flow from the second-stage regenerator low-temperature end 22*b* through the clearance 31 to the second-stage pulse tube low-temperature end 24*b*. The return gas from the second-stage pulse tube 24 can flow from the second-stage pulse tube low-temperature end 24*b* through the clearance 31 to the second-stage regenerator low-temperature end 22*b*.

In this way, the cooling stage (28, 30) couples one end part (18*b*, 24*b*) of the pulse tube (18, 24) in the longitudinal direction and one end part (16*b*, 22*b*) of the regenerator (16, 22) in the longitudinal direction to each other so that the working gas can be made to flow both.

The cooling stage (28, 30) and the insert 32 are formed of, for example, a metallic material, such as copper, which has high thermal conductivity. However, the cooling stage (28, 30) and the insert 32 are not essentially formed of the same material, and may be formed of different materials.

An object to be cooled 34 is thermally combined with the second-stage cooling stage 30. The object to be cooled 34 may be directly installed on the second-stage cooling stage 30, or may be thermally combined with the second-stage cooling stage 30 via a rigid or flexible heat transfer member. The pulse tube cryocooler 10 can cool the object to be cooled 34 by the conduction cooling from the second-stage cooling stage 30. In addition, the object to be cooled 34 cooled by the pulse tube cryocooler 10 is not limited to solid matter, such as superconducting electromagnets or other superconducting devices, or infrared imaging devices or other sensors. The pulse tube cryocooler 10 can also cool the gas or liquid contacting the second-stage cooling stage 30.

Additionally, the first-stage cooling stage 28 may of course cool an object to be cooled that is different from the object to be cooled 34. For example, a radiation shield for reducing or preventing entering of heat into the object to be cooled 34 may be thermally combined with the first-stage cooling stage 28.

Meanwhile, the first-stage regenerator high-temperature end 16*a*, the first-stage pulse tube high-temperature end 18*a*, and the second-stage pulse tube high-temperature end 24*a* are connected to each other by a flange part 36. The flange part 36 is attached to a supporting part 38, such as a supporting base or a supporting wall, in which the pulse tube cryocooler 10 is installed. The supporting part 38 may be a wall member or other parts of a heat-insulating container or a vacuum vessel that houses the cooling stage (28, 30) and the object to be cooled 34.

The pulse tube (18, 24) and the regenerator (16, 22) extend from one main surface of the flange part 36 to the cooling stage (28, 30), and a valve member 40 is provided on the other main surface of the flange part 36. The main pressure switching valve 14, the first-stage auxiliary pressure switching valve 20, and the second-stage auxiliary pressure switching valve 26 are housed in the valve member 40. Hence, in a case where the supporting part 38 constitutes a portion of the heat-insulating container or the vacuum vessel, when the flange part 36 is attached to the supporting part 38, the pulse tubes (18, 24), the regenerators (16, 22), and the cooling stages (28, 30) are housed within the container, and the valve member 40 is disposed out of the container.

In addition, it is not necessary that the valve member 40 is directly attached to the flange part 36. The valve member 40 may be disposed separately from the cold head 11 of the pulse tube cryocooler 10, and may be connected to the cold head 11 by a rigid or flexible pipe. In this way, the phase control mechanism of the pulse tube cryocooler 10 may be disposed separately from the cold head 11.

The main pressure switching valve 14 is configured such that the first-stage regenerator high-temperature end 16*a* is alternately connected to the compressor discharge port 12*a* and the compressor suction port 12*b* in order to create pressure vibration within the pulse tube (18, 24). The main pressure switching valve 14 is configured such that one of the main suction opening/closing valve V1 and the main exhaust opening/closing valve V2 is open and the other thereof is closed. The main suction opening/closing valve V1 connects the compressor discharge port 12*a* to the first-stage regenerator high-temperature end 16*a*, and the main exhaust opening/closing valve V2 connects the compressor suction port 12*b* to the first-stage regenerator high-temperature end 16*a*.

When the main suction opening/closing valve V1 is open, the working gas is supplied from the compressor discharge port 12*a* through the high-pressure line 13*a* and the main suction opening/closing valve V1 to the regenerators (16, 22). The working gas is further supplied from the second-stage regenerator 22 through the clearance 31 to the second-stage pulse tube 24, and is supplied from the first-stage regenerator 16 through the first-stage communication passage 29 to the first-stage pulse tube 18. Meanwhile, when the main exhaust opening/closing valve V2 is open, the working gas is recovered from the pulse tube (18, 24) through the regenerator (16, 22), the main exhaust opening/closing valve V2, and the low-pressure line 13*b* to the compressor suction port 12*b*.

The first-stage auxiliary pressure switching valve 20 is configured such that the first-stage pulse tube high-temperature end 18*a* is alternately connected to the compressor discharge port 12*a* and the compressor suction port 12*b*. The first-stage auxiliary pressure switching valve 20 is configured such that one of the first-stage auxiliary suction opening/closing valve V3 and the first-stage auxiliary exhaust opening/closing valve V4 is open and the other thereof is closed. The first-stage auxiliary suction opening/closing valve V3 connects the compressor discharge port 12*a* to the first-stage pulse tube high-temperature end 18*a*, and the first-stage auxiliary exhaust opening/closing valve V4 connects the compressor suction port 12*b* to the first-stage pulse tube high-temperature end 18*a*.

When the first-stage auxiliary suction opening/closing valve V3 is open, the working gas is supplied from the compressor discharge port 12*a* through the high-pressure line 13*a*, the first-stage auxiliary suction opening/closing valve V3, and the first-stage pulse tube high-temperature end 18*a* to the first-stage pulse tube 18. On the other hand, when the first-stage auxiliary exhaust opening/closing valve V4 is open, the working gas is recovered from the first-stage pulse tube 18 through the first-stage pulse tube high-temperature end 18*a*, the first-stage auxiliary exhaust opening/closing valve V4, and the low-pressure line 13*b* to the compressor suction port 12*b*.

The second-stage auxiliary pressure switching valve 26 is configured such that the second-stage pulse tube high-temperature end 24*a* is alternately connected to the compressor discharge port 12*a* and the compressor suction port 12*b*. The second-stage auxiliary pressure switching valve 26 is configured such that one of the second-stage auxiliary suction opening/closing valve V5 and the second-stage auxiliary exhaust opening/closing valve V6 is open and the other thereof is closed. The second-stage auxiliary suction opening/closing valve V5 connects the compressor discharge port 12*a* to the second-stage pulse tube high-temperature end 24*a*, and the second-stage auxiliary exhaust opening/closing valve V6 connects the compressor suction port 12*b* to the second-stage pulse tube high-temperature end 24*a*.

When the second-stage auxiliary suction opening/closing valve V5 is open, the working gas is supplied from the compressor discharge port 12*a* through the high-pressure line 13*a*, the second-stage auxiliary suction opening/closing valve V5, and the second-stage pulse tube high-temperature end 24*a* to the second-stage pulse tube 24. On the other hand, when the second-stage auxiliary exhaust opening/closing valve V6 is open, the working gas is recovered from the second-stage pulse tube 24 through the second-stage pulse tube high-temperature end 24*a*, the second-stage auxiliary exhaust opening/closing valve V6, and the low-pressure line 13*b* to the compressor suction port 12*b*.

As valve timings of the valves (V1 to V6), it is possible to adopt various valve timings that are applicable to existing four-valve type pulse tube cryocooler.

There may be various specific configurations of the valves (V1 to V6). For example, a group of valves (V1 to V6) may take the form of, for example, a plurality of individually controllable valves, such as electromagnetic opening/closing valves. The valves (V1 to V6) may be constituted as rotary valves.

By virtue of such a configuration, the pulse tube cryocooler 10 creates pressure vibrations of the working gases of the high pressure PH and the low pressure PL within the pulse tube (18, 24). Displacement vibration of the working gas, that is, reciprocation of a gas piston, occurs within the pulse tube (18, 24) in synchronization with suitable phase lags of the pressure vibrations. The movement of the working gas that periodically reciprocates up and down within the pulse tube (18, 24) while maintaining a certain pressure is often referred to as the "gas piston," and is used well in order to describe the operation of the pulse tube cryocooler 10. When the gas piston is at or near the pulse tube high-temperature end (18*a*, 24*a*), the working gas expands in the pulse tube low-temperature end (18*b*, 24*b*), and coldness occurs. By repeating such a refrigeration cycle, the pulse tube cryocooler 10 can cool the cooling stage (28, 30). Hence, the pulse tube cryocooler 10 can cool the object to be cooled 34.

Figure 2:
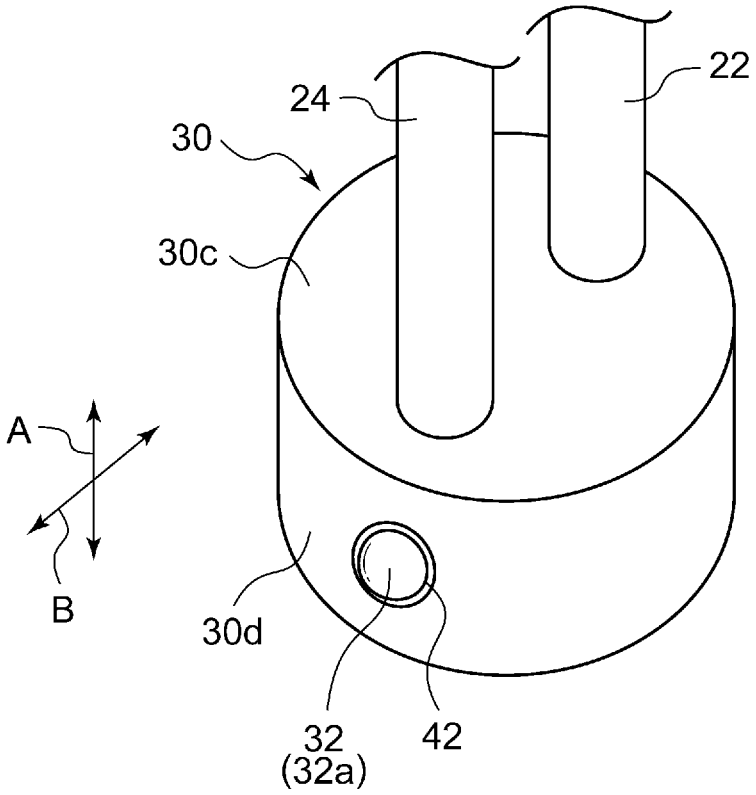
FIG. 2 is a schematic perspective view illustrating an example of a cooling stage structure of the pulse tube cryocooler illustrated in FIG. 1.
Figure 3:
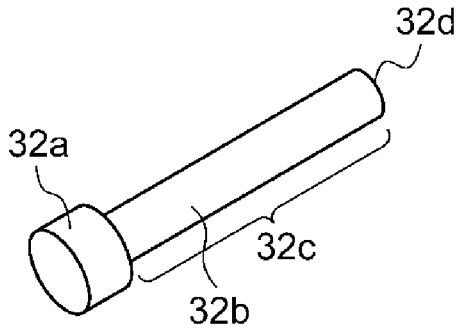
FIG. 3 is a schematic perspective view illustrating an insert involving the embodying mode.
Figure 4:
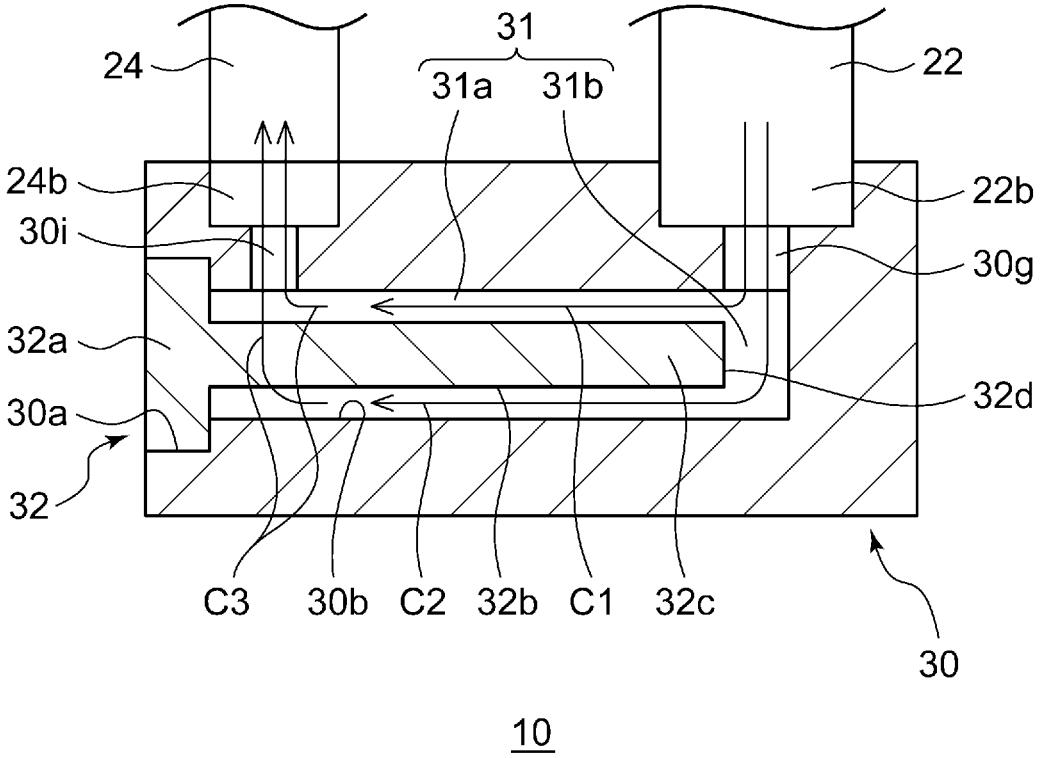
FIG. 4 is a schematic view illustrating a working gas flow in the cooling stage structure of the pulse tube cryocooler involving the embodying mode.

With reference to FIGS. 2 to 4 together with FIG. 1, the configuration of the second-stage cooling stage 30 will be described in more detail. FIG. 2 is a schematic perspective view illustrating the second-stage cooling stage 30 of the pulse tube cryocooler 10 illustrated in FIG. 1 and the periphery thereof. FIG. 3 is a schematic perspective view illustrating the insert 32 involving this embodiment. FIG. 4 is a schematic view illustrating a flow of the working gas that flows between the second-stage cooling stage 30 and the insert 32 of the pulse tube cryocooler 10 illustrated in FIG. 1.

The second-stage cooling stage 30 has a lateral-surface opening 30*a* and a first heat-exchange surface 30*b*. Additionally, the second-stage cooling stage 30 has an upper surface 30*c*, a side surface 30*d*, and a lower surface 30*e*.

The second-stage cooling stage 30 has a short columnar shape or a disk shape as an example. The height of the second-stage cooling stage 30 in the longitudinal direction A, that is, the distance from the upper surface 30*c* to the lower surface 30*e* is smaller than the diameter of the second-stage cooling stage 30, for example, smaller than half of the diameter of the second-stage cooling stage 30. The second-stage regenerator low-temperature end 22*b* and the second-stage pulse tube low-temperature end 24*b* are bonded to the upper surface 30*c*. On the upper surface 30*c*, the second-stage regenerator low-temperature end 22*b* and the second-stage pulse tube low-temperature end 24*b* are mutually separated from each other in the sideways direction B. The lateral-surface opening 30*a* is formed in the side surface 30*d*. The object to be cooled 34 is installed on the lower surface 30*e*.

The lateral-surface opening 30*a* is a substantially circular opening formed in the side surface 30*d* of the second-stage cooling stage 30 as an example, and the diameter thereof is smaller than the height of the second-stage cooling stage 30 in the longitudinal direction A. The diameter of the lateral-surface opening 30*a* may be smaller than half of the height of the second-stage cooling stage 30 in the longitudinal direction A.

The first heat-exchange surface 30*b* extends in the sideways direction B from the lateral-surface opening 30*a* into the second-stage cooling stage 30. The first heat-exchange surface 30*b* defines a cavity part within the second-stage cooling stage 30 for receiving the insert 32. The cavity part is a so-called lateral hole that is formed in the sideways direction B from the lateral-surface opening 30*a* into the second-stage cooling stage 30. The cavity part serves as a dead end without passing through the second-stage cooling stage 30 at the deepest part separated in the sideways direction B from the lateral-surface opening 30*a*. Therefore, the lateral-surface opening 30*a* is an only outlet that connects the cavity part to the outside of the second-stage cooling stage 30. When the lateral-surface opening 30*a* is blocked, the cavity part is isolated from the outside, and the working gas does not leak from the cavity part.

Additionally, the second-stage cooling stage 30 has a first upper surface opening part 30*f*, a regenerator communication passage 30*g*, a second upper surface opening part 30*h*, and a pulse tube communication passage 30*i*.

The first upper surface opening part 30*f* is formed in the upper surface 30*c* of the second-stage cooling stage 30 in order to attach the second-stage regenerator 22 to the second-stage cooling stage 30. The first upper surface opening part 30*f* is a substantially circular opening in the upper surface 30*c* of the second-stage cooling stage 30, and the diameter thereof is equal to the diameter of the second-stage regenerator 22. The second-stage regenerator low-temperature end 22*b* is anchored to the first upper surface opening part 30*f* by a suitable bonding method, such as brazing.

The regenerator communication passage 30*g* opens in the first heat-exchange surface 30*b*, and allows the clearance 31 to communicate with the second-stage regenerator low-temperature end 22*b*. The regenerator communication passage 30*g* is a so-called longitudinal hole that is formed in the longitudinal direction A from the first upper surface opening part 30*f* to the cavity part within the second-stage cooling stage 30. The diameter of the regenerator communication passage 30*g* is smaller than the diameter of the first upper surface opening part 30*f*. The working gas can flow from the second-stage regenerator low-temperature end 22*b* through the regenerator communication passage 30*g* to the clearance 31.

The second upper surface opening part 30*h* is formed in the upper surface 30*c* of the second-stage cooling stage 30 in order to attach the second-stage pulse tube 24 to the second-stage cooling stage 30. The second upper surface opening part 30*h* is a substantially circular opening in the upper surface 30*c* of the second-stage cooling stage 30, and the diameter thereof is equal to the diameter of the second-stage pulse tube 24. The second-stage pulse tube 24 is anchored to the second upper surface opening part 30*h* by a suitable bonding method, such as brazing.

The pulse tube communication passage 30*i* opens in the first heat-exchange surface 30*b*, and allows the clearance 31 to communicate with the second-stage pulse tube low-temperature end 24*b*. The pulse tube communication passage 30*i* is another longitudinal hole that is formed in the longitudinal direction A from the second upper surface opening part 30*h* to the cavity part within the second-stage cooling stage 30. The diameter of the pulse tube communication passage 30*i* is smaller than the diameter of the second upper surface opening part 30*h*. The working gas can flow from the second-stage pulse tube low-temperature end 24*b* through the pulse tube communication passage 30*i* to the clearance 31.

The insert 32 includes a base-end portion 32*a* and a second heat-exchange surface 32*b*. Additionally, the insert 32 protrudes in the sideways direction B from the base-end portion 32*a*, and includes a solid virgate portion 32*c* having the second heat-exchange surface 32*b* as an outer surface thereof.

The insert 32 is in the form of a round bar for example. The solid virgate portion 32*c* extends coaxially from the base-end portion 32*a*. Regarding the length in the sideways direction B, the solid virgate portion 32*c* is longer than the base-end portion 32*a*. For example, the solid virgate portion 32*c* is twice, five times, or ten times longer than the base-end portion 32*a* in the sideways direction B. Additionally, the diameter of the solid virgate portion 32*c* is smaller than the diameter of the base-end portion 32*a*. The diameter of the base-end portion 32*a* and the length thereof in the sideways direction B may almost the same, or the diameter may be longer than the length. The length of the solid virgate portion 32*c* in the sideways direction B is longer than, for example, twice, five times, or ten times longer than the diameter of the solid virgate portion 32*c*. In this way, the insert 32 has a shape that extends in an elongated manner in the sideways direction B. Therefore, the sideways direction B can also be referred to as the axial direction of the insert 32. The longitudinal direction A can also be referred to as the radial direction of the insert 32.

The base-end portion 32*a* fixedly fits into the second-stage cooling stage 30 to plug the lateral-surface opening 30*a*. The diameter of the base-end portion 32*a* is equal to the diameter of the lateral-surface opening 30*a*. The base-end portion 32*a* is fixed into the lateral-surface opening 30*a* by a suitable bonding method, such as brazing. A bonded interface 42 is formed at a boundary between the base-end portion 32*a* and the lateral-surface opening 30*a*. In the case of brazing bonding, the bonded interface 42 contains a wax material, a base material of the second-stage cooling stage 30, and a base material of the insert 32. In this way, the insert 32 is integrated with the second-stage cooling stage 30 and is thermally combined with the second-stage cooling stage 30.

The second heat-exchange surface 32*b* extends in the sideways direction B from the base-end portion 32*a*, and is disposed within the second-stage cooling stage 30 so as to face the first heat-exchange surface 30*b*. Therefore, the insert 32 forms the clearance 31 for making the working gas to flow between the first heat-exchange surface 30*b* and the second heat-exchange surface 32*b* such that both the first heat-exchange surface 30*b* and the second heat-exchange surface 32*b* come into contact with the working gas.

As an example, the second heat-exchange surface 32*b* is a cylindrical surface that extends in the sideways direction B, the first heat-exchange surface 30*b* is a cylindrical surface that extends in the sideways direction B so as to surround the second heat-exchange surface 32*b*, and both the heat-exchange surfaces are coaxially disposed. The first heat-exchange surface 30*b* and the second heat-exchange surface 32*b* are not in contact with each other. A lateral gas flow channel 31*a* for making the working gas flow in the sideways direction B is formed between the first heat-exchange surface 30*b* and the second heat-exchange surface 32*b*. The lateral gas flow channel 31*a* becomes a portion of the clearance 31.

A tip part 32*d* of the insert 32, that is, a terminal of the solid virgate portion 32*c* opposite to the base-end portion 32*a* in the sideways direction B has a slight gap 31*b* between the tip part 32*d* and the deepest part of the cavity part within the second-stage cooling stage 30. The tip part 32*d* of the insert 32 is not in contact with the first heat-exchange surface 30*b*. The gap 31*b* also becomes a portion of the clearance 31. As an example, the gap 31*b* is located immediately below the regenerator communication passage 30*g*, and the gas flowing out of the regenerator communication passage 30*g* flows into the gap 31*b*.

The regenerator communication passage 30*g* and the pulse tube communication passage 30*i* are disposed side by side in the sideways direction B. The regenerator communication passage 30*g* and the pulse tube communication passage 30*i* are located opposite to each other with the center of the upper surface 30*c* of the second-stage cooling stage 30 interposed therebetween. The lateral-surface opening 30*a* is located near the pulse tube communication passage 30*i*. A direction in which the insert 32 extends, and a direction in which the regenerator communication passage 30*g* and the pulse tube communication passage 30*i* are aligned with each other coincide with each other, and both the directions are the sideways directions B.

In addition, the second-stage regenerator 22 and the second-stage pulse tube 24 have a relationship in which the positions thereof are opposite to each other. That is, the lateral-surface opening 30*a* may be located not near the second-stage pulse tube 24 but near the second-stage regenerator 22. In that case, the insert 32 extends from the base-end portion 32*a* to a position immediately below the regenerator communication passage 30*g*, and the tip part 32*d* of the insert 32 reaches a position immediately below or near the pulse tube communication passage 30*i*.

A working gas flow in the clearance 31 when the working gas flows from the second-stage regenerator 22 to the second-stage pulse tube 24 is schematically illustrated in FIG. 4. Since the insert 32 is disposed within the second-stage cooling stage 30, the working gas flowing into the second-stage cooling stage 30 from the second-stage regenerator 22 is branched in a plurality of directions by the insert 32.

The working gas flows from the second-stage regenerator low-temperature end 22*b* through the regenerator communication passage 30*g* into the clearance 31. A portion of the working gas flows into the lateral gas flow channel 31*a* directly from the regenerator communication passage 30*g* (arrow C1). The other portion of the working gas flows from the regenerator communication passage 30*g* through the gap 31*b* into the lateral gas flow channel 31*a* (arrow C2). In this way, the working gas branched in the plurality of directions at the tip part 32*d* of the insert 32 flows through the clearance 31 so as to surround the solid virgate portion 32*c*. The working gas merges into the pulse tube communication passage 30*i*, and further flows to the second-stage pulse tube low-temperature end 24*b* (arrow C3).

Similarly, also when the working gas flows from the second-stage pulse tube 24 to the second-stage regenerator 22, the working gas can be branched in the plurality of directions by the insert 32 and can flow through the clearance 31.

According to the pulse tube cryocooler 10 involving this embodiment, the insert 32 is inserted into the second-stage cooling stage 30, and the clearance 31 for making the working gas flow is formed around the insert 32 within the second-stage cooling stage 30. The clearance 31 is formed between the first heat-exchange surface 30*b* of the second-stage cooling stage 30 and the second heat-exchange surface 32*b* of the insert 32. For that reason, the flow of the working gas passing through the clearance 31 can come into contact with both the first heat-exchange surface 30*b* and the second heat-exchange surface 32*b* and can perform heat exchange therewith.

Supposing that the insert 32 is not provided, the second heat-exchange surface 32*b* is not present, either. For that reason, the working gas performs heat exchange with the first heat-exchange surface 30*b*. However, according to the pulse tube cryocooler 10 involving this embodiment, the insert 32 is inserted into the second-stage cooling stage 30, and the surface thereof is used as the second heat-exchange surface 32*b*. Hence, the heat exchange area can be increased. The heat exchange efficiency in the second-stage cooling stage 30 is enhanced, and an improvement in the refrigeration performance of the pulse tube cryocooler 10 is also expected.

Additionally, the insert 32 involving this embodiment has a relatively simple shape, for example, a round rod shape. Accordingly, the cavity part of the second-stage cooling stage 30 that receives the insert 32 may also have a relatively simple shape. Hence, the cooling stage structure involving this embodiment is easily manufactured compared to a complicated shape as in a slit type heat exchanger that has been known from the related art, and manufacturing costs can also be kept low. Especially in a case where the insert 32 has the solid virgate portion 32*c*, the shape thereof is simple and manufacturing advantages thereof are high.

Figure 5:
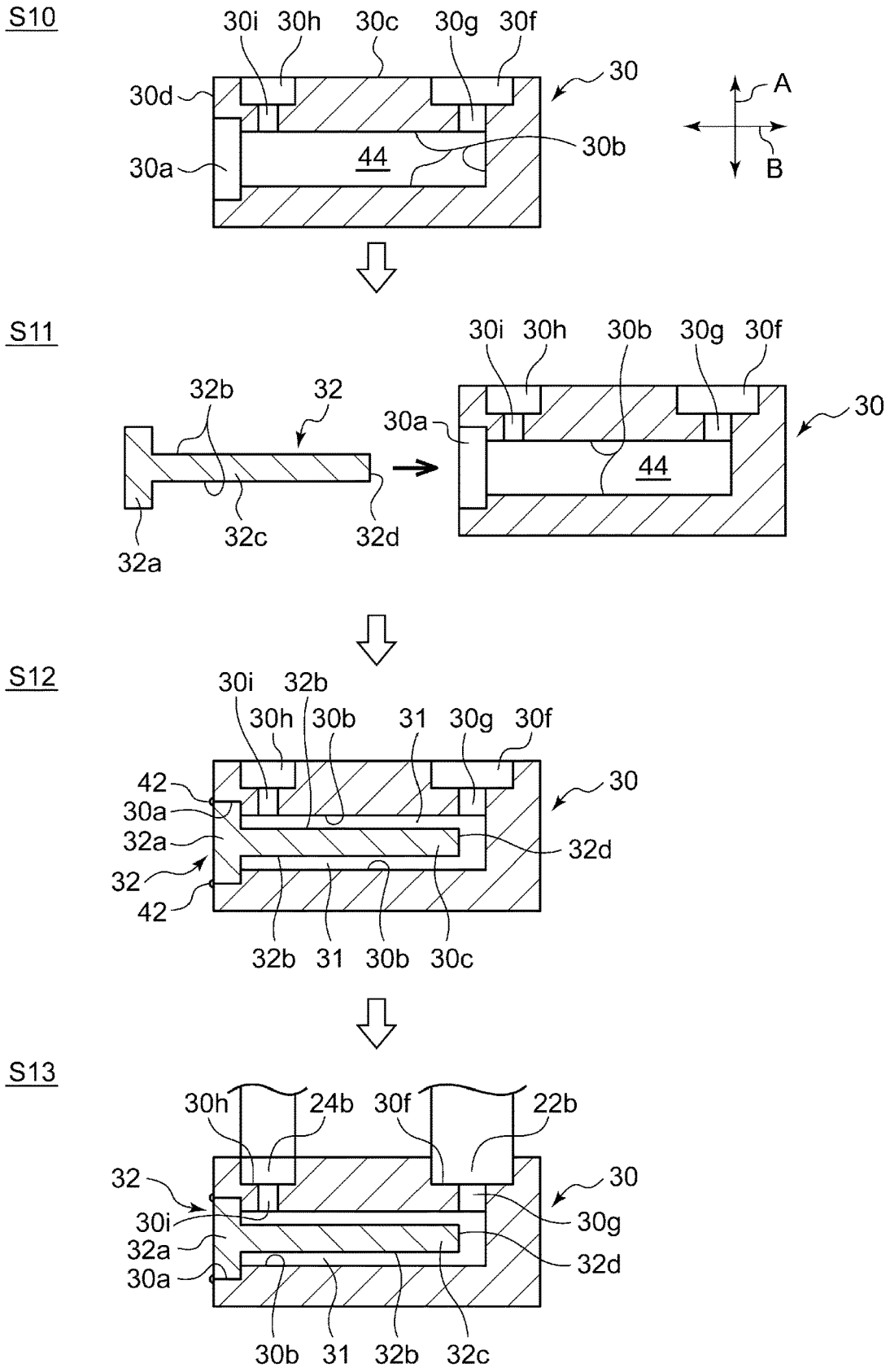
FIG. 5 is a schematic view illustrating a method of manufacturing the pulse tube cryocooler involving the embodying mode.

An example of a method of manufacturing the pulse tube cryocooler 10 involving this embodiment will be described with reference to FIG. 5. Main steps regarding manufacturing of the second-stage cooling stage 30 in the method of manufacturing the pulse tube cryocooler 10 will be described below.

First, the lateral-surface opening 30*a* and the first heat-exchange surface 30*b* are formed in the second-stage cooling stage 30 (S10). In this way, the cavity part 44 is formed within the second-stage cooling stage 30. The cavity part 44 is formed in a side surface (equivalent to the side surface 30*d* of the second-stage cooling stage 30) of a block of a high thermally-conductive material, such as copper, by performing suitable machining. As described above, the first heat-exchange surface 30*b* extends in the sideways direction B from the lateral-surface opening 30*a* into the second-stage cooling stage 30. In addition, the first upper surface opening part 30*f*, the regenerator communication passage 30*g*, the second upper surface opening part 30*h*, and the pulse tube communication passage 30*i* are formed by performing suitable machining on an upper surface (equivalent to the upper surface 30*c* of the second-stage cooling stage 30) of the block. The longitudinal holes (30*f* to 30*i*) extend to the longitudinal direction A from the upper surface 30*c* into the second-stage cooling stage 30.

This opening formation step may also include casting of the high thermally-conductive material, such as copper. The block having the lateral-surface opening 30*a*, the first heat-exchange surface 30*b*, the cavity part 44, and/or if necessary, the other openings (30*f* to 30*i*) may be formed by casting.

Next, the insert 32 is inserted into the cavity part 44 of the second-stage cooling stage 30 from the lateral-surface opening 30*a* (S11). Therefore, the insert 32 including the base-end portion 32*a* and the second heat-exchange surface 32*b* is prepared. As described above, the insert 32 has the solid virgate portion 32*c* extending from the base-end portion 32*a* and having the second heat-exchange surface 32*b*. The insert 32 is inserted into the cavity part 44 so as to enter the lateral-surface opening 30*a* from the tip part 32*d* of the solid virgate portion 32*c*. In this way, the second heat-exchange surface 32*b* extends in the sideways direction B from the base-end portion 32*a*, and is disposed within the second-stage cooling stage 30 so as to face the first heat-exchange surface 30*b*. The base-end portion 32*a* is fitted into the lateral-surface opening 30*a* due to the coincidence of the shapes of the base-end portion 32*a* and the lateral-surface opening 30*a*. Accordingly, the solid virgate portion 32*c* is supported within the cavity part 44 such that the second heat-exchange surface 32*b* is not in contact with the first heat-exchange surface 30*b*. The insertion of the insert 32 can be performed, for example, manually.

The insert 32 fixedly fits into the second-stage cooling stage 30 such that the base-end portion 32*a* plugs the lateral-surface opening 30*a* (S12). The base-end portion 32*a* is bonded to the lateral-surface opening 30*a* by a suitable bonding method, such as brazing. As described above, the bonded interface 42 is formed at the boundary between the base-end portion 32*a* and the lateral-surface opening 30*a*. In this way, the insert 32 is integrated with the second-stage cooling stage 30, so that both cannot be separated from each other.

Moreover, the second-stage pulse tube low-temperature end 24*b* and the second-stage regenerator low-temperature end 22*b* are coupled to the second-stage cooling stage 30 such that the working gas can flow between both through the second-stage cooling stage 30 (S13). The second-stage regenerator low-temperature end 22*b* is inserted into the first upper surface opening part 30*f*, and the second-stage pulse tube low-temperature end 24*b* is inserted into the second upper surface opening part 30*h*. This coupling can be performed using suitable a bonding method, such as brazing. In a case where the bonding is performed by brazing, this coupling step (S13) may be performed together with an anchoring step (S12) of the insert 32.

In this way, the clearance 31 for making the working gas to flow is formed between the first heat-exchange surface 30*b* and the second heat-exchange surface 32*b* such that both the first heat-exchange surface 30*b* and the second heat-exchange surface 32*b* come into contact with the working gas. By inserting the insert 32 into the second-stage cooling stage 30 and forming the clearance 31, the working gas can exchange heat not only with the first heat-exchange surface 30*b* but also with the second heat-exchange surface 32*b*. The heat exchange area is increased, the heat exchange efficiency in the second-stage cooling stage 30 is enhanced, and an improvement in the refrigeration performance of the pulse tube cryocooler 10 is expected.

According to the method of manufacturing the pulse tube cryocooler 10 involving this embodiment, the area of heat exchange with the working gas can be increased by a relatively simple method of inserting and anchoring the insert 32 to the second-stage cooling stage 30. Therefore, the pulse tube cryocooler 10 having the cooling stage structure in which an increase in the area of heat exchange with the working gas can be realized at low costs can be provided.

There may be various specific configurations of the cooling stage structure involving this embodiment. Several examples will be described below with reference to FIGS. 6 to 11.

Figure 6:
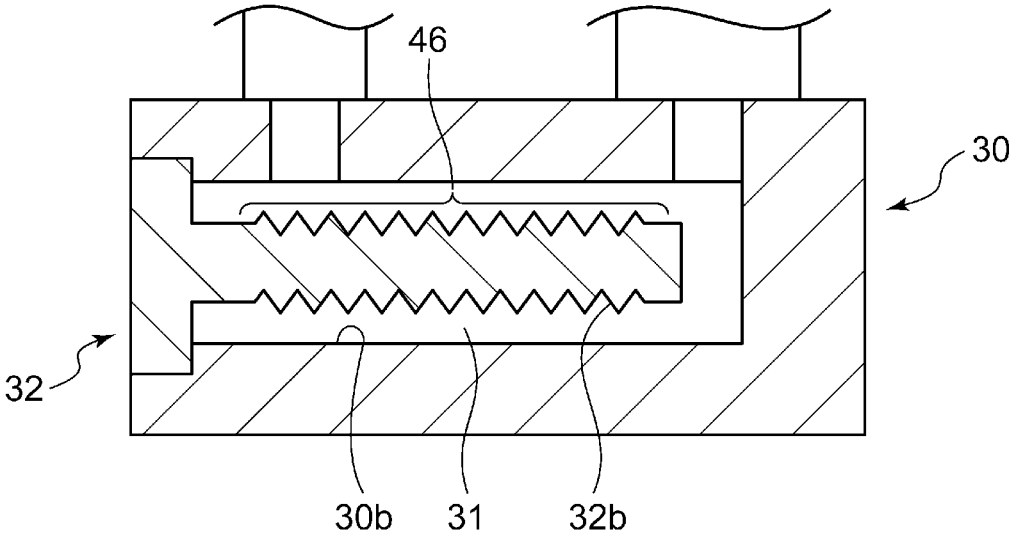
FIG. 6 is a schematic view illustrating another example of the cooling stage structure of the pulse tube cryocooler involving the embodying mode.

A illustrated in FIG. 6, grooves 46 may be formed in the second heat-exchange surface 32*b*. The grooves 46 may be, for example, spiral grooves formed in the virgate portion of the insert 32, or may be in some other corrugated form of choice. In this way, the area of the second heat-exchange surface 32*b* can be increased by forming the groove 46 or the corrugations. In addition, area increasing means, such the grooves 46 or the corrugations, may be added to the first heat-exchange surface 30*b*, or may be added to any other heat-exchange surface (for example, a third heat-exchange surface 54 to be described below) that comes into contact with the working gas flowing to the clearance 31.

Figure 7:
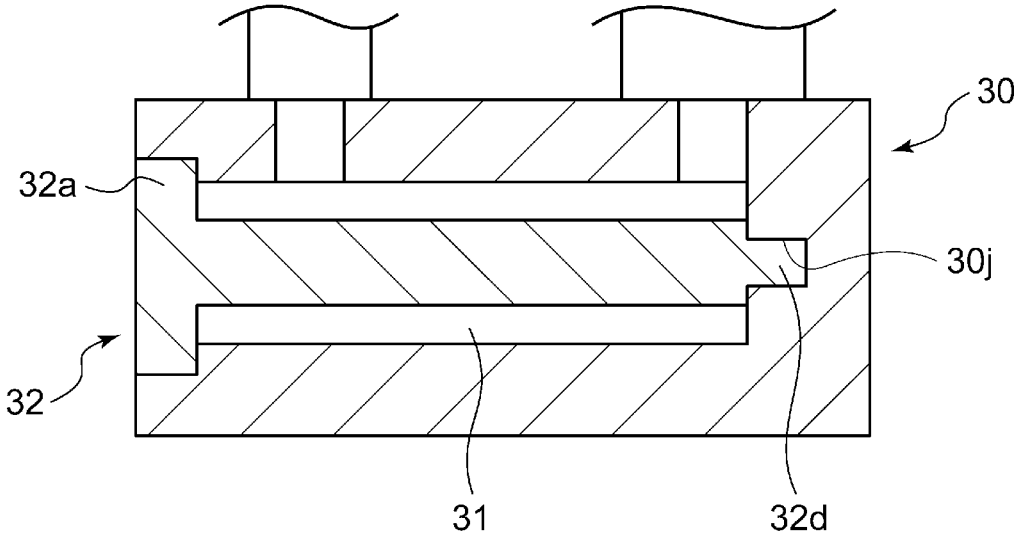
FIG. 7 is a schematic view illustrating still another example of the cooling stage structure of the pulse tube cryocooler involving the embodying mode.

As illustrated in FIG. 7, the insert 32 may include the cooling stage, for example, the tip part 32*d* supported by the second-stage cooling stage 30. The tip part 32*d* of the insert 32 is supported by an insert supporting hole 30*j* of the second-stage cooling stage 30. The insert supporting hole 30*j* is formed at the deepest part of the cavity part of the second-stage cooling stage 30. Thus, when the insert 32 is inserted into the cavity part of the second-stage cooling stage 30, the tip part 32*d* of the insert 32 is inserted into the insert supporting hole 30*j*. The tip part 32*d* may have a tapered shape. By supporting the insert 32 at both ends (32*a*, 32*d*) in this way, it is easy to suppress eccentricity or deflection of the insert 32 compared to a case where the insert 32 is supported only by the base-end portion 32*a*. It is easy to realize the clearance 31 with design dimensions.

Figure 8:
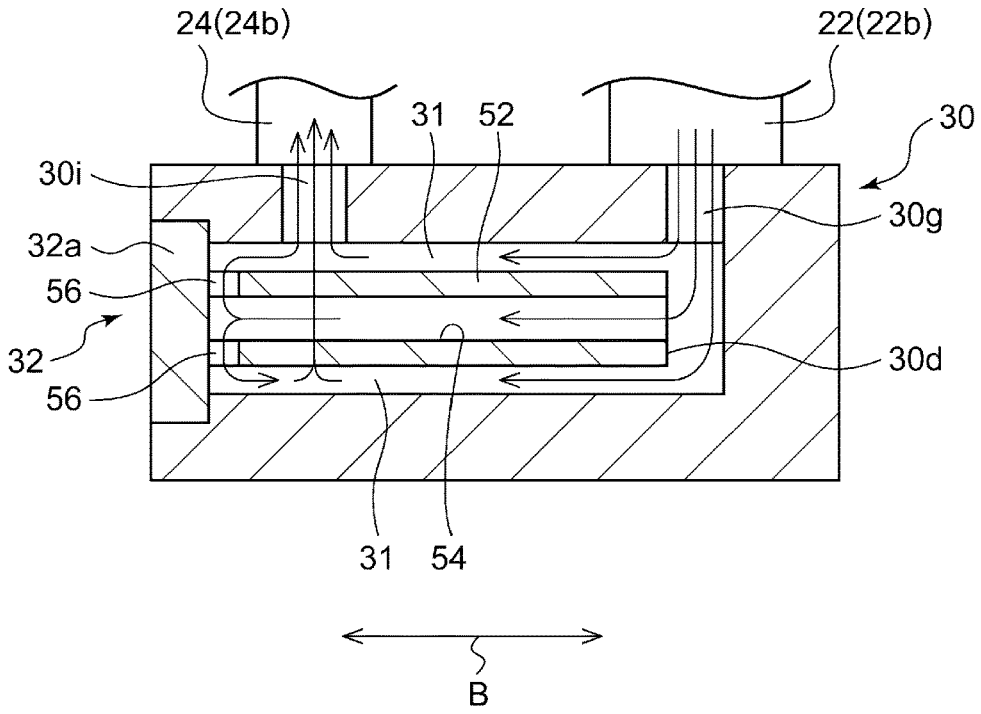
FIG. 8 is a schematic view illustrating a still further example of the cooling stage structure of the pulse tube cryocooler involving the embodying mode.

As illustrated in FIG. 8, the insert 32 may protrude in the sideways direction B from the base-end portion 32*a*, and may include a hollow virgate portion 52 having the second heat-exchange surface 32*b* as the outer surface thereof. The hollow virgate portion 52 is formed in a hollow shape so as to have the third heat-exchange surface 54 extending in the sideways direction B and coming into contact with the working gas as an inner surface thereof. The hollow virgate portion 52 opens to the tip part 32*d* and also has a plurality of gas flow holes 56 on the base-end portion 32*a* side. The gas flow holes 56 are disposed adjacent to the base-end portion 32*a* in the sideways direction B. The gas flow holes 56 may be located outside the pulse tube communication passage 30*i* with respect to a central part of the second-stage cooling stage 30.

In FIG. 8, a flow of the working gas that flows from the second-stage regenerator 22 through the second-stage cooling stage 30 to the second-stage pulse tube 24 is exemplified by an arrow. As illustrated in the drawing, the working gas flows from the second-stage regenerator low-temperature end 22*b* through the regenerator communication passage 30*g* into the second-stage cooling stage 30 and is branched into several working gas flows. A portion of the working gas flows toward the pulse tube communication passage 30*i* through the clearance 31. The other portion of the working gas can flow to the gas flow holes 56 while flowing from the tip part 32*d* to the hollow part of the insert 32 and exchanging heat with the third heat-exchange surface 54. The working gas flowing out of the gas flow holes 56 merges into the working gas from the clearance 31, and flows to the second-stage pulse tube low-temperature end 24*b* through the pulse tube communication passage 30*i*. On the contrary, also when the working gas flows from the second-stage pulse tube 24 to the second-stage regenerator 22, the working gas can be branched and flow to the clearance 31 and the hollow part of the insert 32.

In this way, the working gas can come into contact with the first heat-exchange surface 30*b*, the second heat-exchange surface 32*b*, and the third heat-exchange surface 54 within the second-stage cooling stage 30 and can perform heat exchange therewith. The heat exchange area is further increased, the heat exchange efficiency in the second-stage cooling stage 30 is enhanced, and an improvement in the refrigeration performance of the pulse tube cryocooler 10 is also expected.

Figure 9:
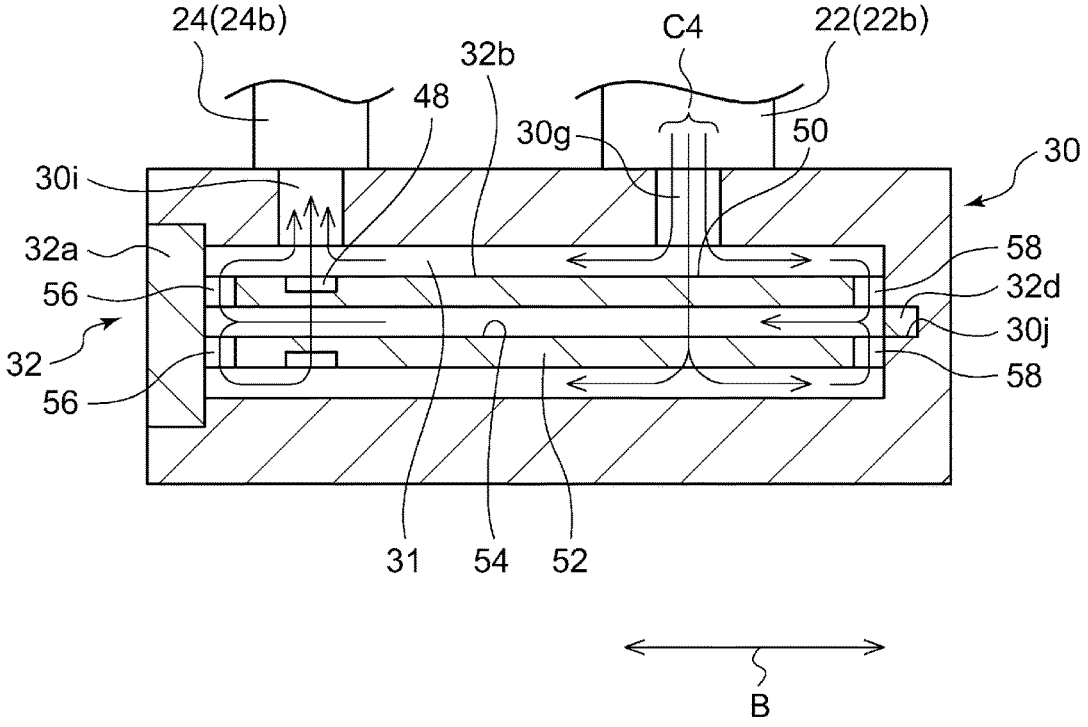
FIG. 9 is a schematic view illustrating a still further example of the cooling stage structure of the pulse tube cryocooler involving the embodying mode.

As illustrated in FIG. 9, the second heat-exchange surface 32*b* may have a pulse-tube facing region 48 and a regenerator facing region 50. The pulse-tube facing region 48 is a region of the second heat-exchange surface 32*b* that faces the pulse tube communication passage 30*i*. Therefore, the pulse-tube facing region 48 receives a flow of the working gas that enters the clearance 31 from the pulse tube communication passage 30*i*. The regenerator facing region 50 is a region of the second heat-exchange surface 32*b* that faces the regenerator communication passage 30*g*. Therefore, the regenerator facing region 50 receives the working gas that enters the clearance 31 from the regenerator communication passage 30*g*.

The insert 32 may extend beyond the regenerator communication passage 30*g* and the pulse tube communication passage 30*i* from the base-end portion 32*a*. The tip part 32*d* of the insert 32 may be located outside the second-stage regenerator 22 and the second-stage pulse tube 24 with respect to the central part of the second-stage cooling stage 30.

The insert 32 includes the hollow virgate portion 52 having the third heat-exchange surface 54 as the inner surface thereof. The tip part 32*d* of the insert 32 is supported by the insert supporting hole 30*j* of the second-stage cooling stage 30. For that reason, the hollow virgate portion 52 also has a plurality of gas flow holes 58 on the tip part 32*d* side. The gas flow holes 58 are disposed adjacent to the tip part 32*d* in the sideways direction B. Also, in the embodiment illustrated in FIG. 9, the hollow virgate portion 52 also has the plurality of gas flow holes 56 on the base-end portion 32*a* side, similarly to the embodiment illustrated in FIG. 8. The gas flow holes 56 are disposed adjacent to the base-end portion 32*a* in the sideways direction B. The gas flow holes 56 and 58 may be located outside the pulse tube communication passage 30*i* and the regenerator communication passage 30*g*, respectively, with respect to the central part of the second-stage cooling stage 30.

In order to facilitate the flow of the working gas, a recess may be formed in at least one of the pulse-tube facing region 48 and the regenerator facing region 50. This recess is formed around a central axis of the insert 32 on the second heat-exchange surface 32*b*. In FIG. 9, the recess is formed in the pulse-tube facing region 48.

As illustrated by arrow C4, when the regenerator facing region 50 receives the working gas flow, the regenerator facing region 50 can direct the flow in a plurality of different directions. Additionally, when the pulse-tube facing region 48 receives the working gas flow, the pulse-tube facing region 48 can direct the flow in a plurality of different directions. The plurality of different directions include, for example, two directions opposite to each other. In FIG. 9, the two directions opposite to each other in the sideways direction B are illustrated.

Even in this way, the area where the working gas comes into contact with the second-stage cooling stage 30 and the insert 32, that is, the heat exchange area is increased.

Figure 10:
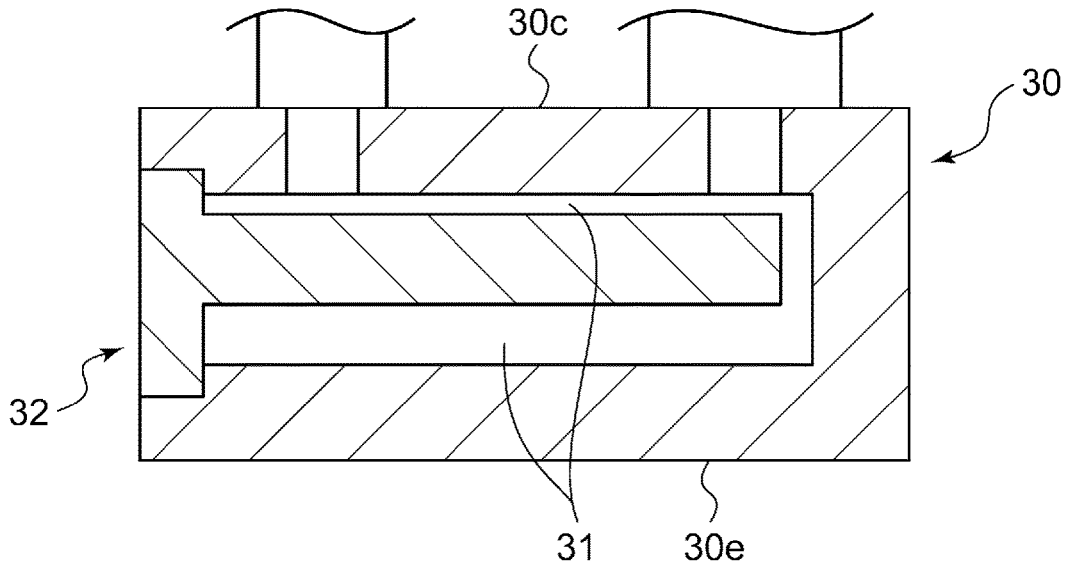
FIG. 10 is a schematic view illustrating a still further example of the cooling stage structure of the pulse tube cryocooler involving the embodying mode.
Figure 11:
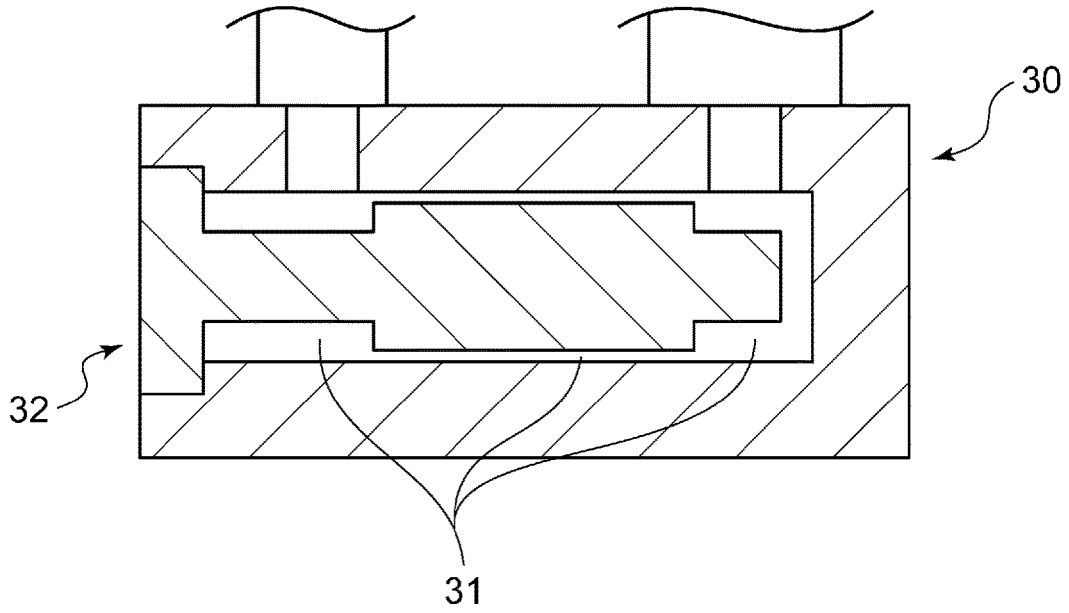
FIG. 11 is a schematic view illustrating a still further example of the cooling stage structure of the pulse tube cryocooler involving the embodying mode.

In order to equalize flow channel resistance, the clearance 31 between the second-stage cooling stage 30 and the insert 32 may vary locally. For example, as illustrated in FIG. 10, the clearance 31 may vary up and down. For example, the clearance 31 may be narrow on the upper surface 30*c* side of the second-stage cooling stage 30, and the clearance 31 may be wide on the lower surface 30*e* side of the second-stage cooling stage 30. Alternatively, as illustrated in FIG. 11, the clearance 31 may vary in the sideways direction B. For example, the clearance 31 may be wide at both ends of the insert 32, and the clearance 31 may be narrow at an intermediate part of the insert 32.

The invention has been described above on the basis of the embodiment. It should be understood by those skilled in the art that the invention is not limited to the above embodiment, that various design changes are possible and various modification examples are possible, and that such modification examples are also within the scope of the invention.

In the above-described embodiment, although the insert 32 is mounted on the second-stage cooling stage 30, the invention is not limited to this. In a certain embodiment, the insert 32 may be mounted on the first-stage cooling stage 28. The insert 32 may be provided in any of a plurality of cooling stages in a multi-stage cryocooler, for example, in a cooling stage of a final stage. Alternatively, the pulse tube cryocooler 10 may be a single-stage cryocooler, and the insert may be provided in the first-stage cooling stage.

In the invention, it is not essential that the pulse tube cryocooler 10 is a four-valve type pulse tube cryocooler. The pulse tube cryocooler 10 may have phase control mechanisms of different configurations, for example, may be a double inlet type pulse tube cryocooler or an active buffer type pulse tube cryocooler.

Various features described in relation to a certain embodiment can also be applied to other embodiments. New embodiments created by combination have the effects of respective combined embodiments in combination.

It should be understood that the invention is not limited to the above-described embodiments, but may be modified into various forms on the basis of the spirit of the invention. Additionally, the modifications are included in the scope of the invention.

What is claimed is:

1. A pulse tube cryocooler comprising:

a longitudinally extending pulse tube;

a regenerator extending in a longitudinal direction of the pulse tube and disposed in a sideways direction apart from and paralleling the pulse tube, wherein the longitudinal direction and the sideways direction are perpendicular;

a cooling stage coupling one longitudinal end of the pulse tube and one longitudinal end of the regenerator to allow a working gas to flow between the two longitudinal ends, and having a lateral-surface opening, and a first heat-exchange surface extending in the sideways direction into the cooling stage from the lateral-surface opening; and an insert furnished with a base-end portion fixedly fitting into the cooling stage to plug the lateral-surface opening, and with a second heat-exchange surface extending in the sideways direction from the base-end portion and disposed inside the cooling stage, opposing the first heat-exchange surface; wherein between the first heat-exchange surface and the second heat-exchange surface the insert forms a clearance for flowing the working gas so that both the first heat-exchange surface and the second heat-exchange surface come into contact with the working gas.

2. The pulse tube cryocooler according to claim 1, wherein either grooves or corrugations are formed in the second heat-exchange surface.

3. The pulse tube cryocooler according to claim 1, wherein the insert is furnished with a tip portion for being supported by the cooling stage.

4. The pulse tube cryocooler according to claim 1, wherein the insert is furnished with a solid virgate portion protruding in the sideways direction from the base-end portion and whose outer surface is the second heat-exchange surface.

5. The pulse tube cryocooler according to claim 1, wherein:

the insert is furnished with a hollow virgate portion protruding in the sideways direction from the base-end portion and whose outer side is the second heat-exchange surface; and the hollow virgate portion is formed hollow to have as the virgate portion's inner side a third heat-exchange surface extending in the sideways direction and coming into contact with the working gas.

6. The pulse tube cryocooler according to claim 1, wherein:

the cooling stage is furnished with a pulse-tube communication passage opening in the first heat-exchange surface and whereby the clearance and the one longitudinal end of the pulse tube communicate, and with a regenerator communication passage opening in the first heat-exchange surface and whereby the clearance and the one longitudinal end of the regenerator communicate; and the second heat-exchange surface has a pulse-tube facing region facing the pulse-tube communication passage and receiving flow of the working gas entering the clearance from the pulse-tube communication passage, and a regenerator facing region facing the regenerator communication passage and receiving the working gas entering the clearance from the regenerator communication passage.

7. A method of manufacturing a pulse tube cryocooler, the pulse tube cryocooler including a longitudinally extending pulse tube, and a regenerator extending in a longitudinal direction of the pulse tube and disposed in a sideways direction apart from and paralleling the pulse tube, the method comprising:

forming in the cooling stage a lateral-surface opening, and forming in the cooling stage a first heat-exchange surface extending in the sideways direction into the cooling stage from the lateral-surface opening, wherein the longitudinal direction and the sideways direction are perpendicular;

inserting an insert, furnished with a base-end portion and a second heat-exchange surface, through the lateral-surface opening such that the second heat-exchange surface extends in the sideways direction from the base-end portion and is disposed inside the cooling stage, opposing the first heat-exchange surface;

fixedly fitting the insert into the cooling stage such that the base-end portion plugs the lateral-surface opening; and coupling one longitudinal end of the pulse tube and one longitudinal end of the regenerator to allow a working gas to flow between the two longitudinal ends; wherein between the first heat-exchange surface and the second heat-exchange surface the insert forms a clearance for flowing the working gas heat-exchange surface heat-exchange surface so that both the first heat-exchange surface and the second heat-exchange surface come into contact with the working gas.

* * * * *